US010233671B2

(12) United States Patent
Du

(10) Patent No.: US 10,233,671 B2
(45) Date of Patent: Mar. 19, 2019

(54) DUAL POWER ELECTRONIC MECHANICAL LOCK

(71) Applicant: Minghao Du, Jiangsu (CN)

(72) Inventor: Minghao Du, Jiangsu (CN)

( * ) Notice: Subject to any disclaimer, the term of this patent is extended or adjusted under 35 U.S.C. 154(b) by 0 days.

(21) Appl. No.: 15/741,745

(22) PCT Filed: Nov. 30, 2015

(86) PCT No.: PCT/CN2015/095932
§ 371 (c)(1),
(2) Date: Jan. 3, 2018

(87) PCT Pub. No.: WO2017/059624
PCT Pub. Date: Apr. 13, 2017

(65) Prior Publication Data

US 2018/0202192 A1 Jul. 19, 2018

(30) Foreign Application Priority Data

Oct. 10, 2015 (CN) ..... 2015 1 065512

(51) Int. Cl.
*E05B 47/00* (2006.01)
*E05B 21/00* (2006.01)
(Continued)

(52) U.S. Cl.
CPC ..... *E05B 47/0012* (2013.01); *E05B 21/00* (2013.01); *E05B 47/0603* (2013.01);
(Continued)

(58) Field of Classification Search
CPC ..... E05B 47/0012; E05B 57/00; E05B 47/00; E05B 29/00; E05B 2047/0073;
(Continued)

(56) References Cited

U.S. PATENT DOCUMENTS 4,671,086 A * 6/1987 Fogleman ..... E05B 47/0002 292/144
4,685,709 A * 8/1987 Kambic ..... E05B 47/0012 292/201
(Continued)

FOREIGN PATENT DOCUMENTS

CN 203879136 U 10/2014
EP 2495379 * 9/2012

OTHER PUBLICATIONS

SIPO, First Office Action, dated May 2, 2017, Application No./Patent No. 201510655512.6.
(Continued)

*Primary Examiner* — Lloyd A Gall

(57) ABSTRACT

A dual-power electromechanical lock is provided. The lock comprises a lock cover and a lock body with a latch therein, wherein the latch is installed in the lock body by a rotation restoring mechanism, the lock body is provided with a main power device in transmission connection with the latch, the lock cover is provided with a key hole corresponding to a key, a mechanical power device corresponding to the main power device is provided inside the lock body, and the mechanical power device is in transmission connection with the main power device.

7 Claims, 7 Drawing Sheets

(51) Int. Cl.
*E05B 57/00* (2006.01)
*E05B 65/00* (2006.01)
*E05B 47/06* (2006.01)

(52) U.S. Cl.
CPC ..... *E05B 57/00* (2013.01); *E05B 65/0075* (2013.01); *E05B 2047/0013* (2013.01); *E05B 2047/0017* (2013.01); *E05B 2047/0024* (2013.01); *E05B 2047/0073* (2013.01); *E05B 2047/0086* (2013.01)

(58) Field of Classification Search
CPC ..... E05B 2047/0017; E05B 2047/0086; E05B 2047/0024; E05B 65/0075; E05B 29/0033; E05B 47/0603; E05B 21/00; E05B 2047/0013
USPC ..... 70/210, 278.7, 279.1, 282, 283; 109/59 R, 59 T; 292/153
See application file for complete search history.

(56) References Cited

U.S. PATENT DOCUMENTS 4,690,073 A * 9/1987 Shoop ..... E05B 13/005 109/59 T
5,010,751 A * 4/1991 Schwartz ..... E05B 47/0012 340/5.66
5,148,691 A * 9/1992 Wallden ..... E05B 47/0012 292/201
5,231,935 A * 8/1993 Oder ..... E05B 65/0082 109/59 R
6,679,087 B2 * 1/2004 Suggs ..... E05B 65/0075 109/59 R
6,786,519 B2 * 9/2004 Gartner ..... E05B 17/2034 109/59 R
7,461,872 B2 * 12/2008 Moon ..... E05B 17/2092 292/109
7,464,570 B1 * 12/2008 Chen ..... E05B 43/005 109/59 R
9,657,500 B2 * 5/2017 Min ..... E05B 47/00
9,845,618 B2 * 12/2017 Worm ..... E05B 65/0075
2003/0140665 A1 * 7/2003 Szuminski ..... E05B 47/0002 70/257
2006/0032418 A1 * 2/2006 Smith ..... E05B 47/0603 109/59 R
2008/0303290 A1 * 12/2008 Yuan ..... E05B 47/0012 292/195
2008/0314100 A1 * 12/2008 Min ..... E05B 47/0012 70/278.1
2018/0016815 A1 * 1/2018 Arnold ..... E05B 47/0012
2018/0051486 A1 * 2/2018 Yuan ..... E05B 17/2034

OTHER PUBLICATIONS

SIPO, Grant Notice, dated Nov. 3, 2017, Application No./Patent No. 201510655512.6.

* cited by examiner

DUAL POWER ELECTRONIC MECHANICAL LOCK

FIELD

This invention belongs to the lock field, specifically relates to a dual power electronic mechanical lock.

BACKGROUND

There are two types of locks. One is a mechanical lock and the other is an electronic lock. Mechanical lock is a traditional lock structure and unlocked through the principle of marble. This kind of lock has poor security and anti-theft performance, which can be easily cracked by thieves. Electronic lock is a new lock structure and unlocked through the principle of electronic circuit. It is convenient and has higher anti-theft coefficient than mechanical locks.

At present, the electronic lock has the problem that is cannot be unlocked when the control circuit or mechanical parts have problems.

So, it is urgent to develop a dual power electronic mechanical lock with reasonable design to control the double circuit electronic mechanical lock by controlling the rotation of main and auxiliary motors through the electronic control circuit and ensure that the auxiliary motor can still unlock the lock through the auxiliary mechanism when the conventional motor or its driving mechanism fails; when the electronic part does not work, the mechanical emergency unlock can be realized through turning the mechanical key and pulling the bracket to indirectly shift down the slider that limits the movement of lock latch.

SUMMARY

The technical problem should be solved in this invention is to overcome the above defects to provide a dual power electronic mechanical lock with reasonable design to control the double circuit electronic mechanical lock by controlling the rotation of main and auxiliary motors through the electronic control circuit and ensure that the auxiliary motor can still unlock the lock through the auxiliary mechanism when the conventional motor or its driving mechanism fails; when the electronic part does not work, the mechanical emergency unlock can be realized through turning the mechanical key and pulling the bracket to indirectly shift down the slider that limits the movement of lock latch.

In order to solve the above problems, the invention adopts the technical scheme is as follows.

Dual power electronic mechanical lock includes the lock body and lock lid. The lock latch is installed in the lock body through the rotating recovery mechanism; characteristics: the primary power device transmitting and connecting the lock latch is installed in the lock body; the keyhole corresponding to the key is located in the lock lid; the mechanical power device corresponding to the primary power device is installed in the lock body; the mechanical power device transmits and connects the primary power device.

As an optimized technical scheme, the described primary power devices include slidable bracket and breadboard in the lock body; primary power source, auxiliary power source and the slider connecting with the lock latch are installed on the bracket; the breadboard connects the primary power source and auxiliary power source; the mentioned primary power source and auxiliary power source are in the same center line, with the cam on the former and auxiliary cam on the latter and the two cams are mechanically connected with each other. The vertically D-shape cam on the power output shaft of the primary power source is driven and connected by the slider through being connected with its special-shaped groove slider. The cam is located in the arc groove at the end of the special-shaped groove when it is in the normal state; the cam will be deflected to restrict the slider from moving at the torsion of the torsional spring installed on the cam; the primary power source will rotate by overcoming the torsion of the torsional spring; when the platform surface of the cam turns parallel with the special-shaped groove surface of the slider, turn the safe handle and push the lock latch blocking surface to rotate inside the lock body; the lock latch end will squeeze (press) the slider and move downward by overcoming spring's elastic force. The lock is unlocked.

As an optimized technical scheme, the described mechanical power devices include the keyhole in the lock lid and keys running through the keyhole; the keys mechanically are connected to the blade group composed of a number of grooved blades; the bracket is arranged with an inserting piece; turn the keys to drive the relative movement of the blade and align the grooves; when aligned grooves are properly lined up with the inserting piece, turn the keys to pull the bracket; the inserting piece will be inserted into the grooves and bracket sliding will drive the slider towards the unlocked direction to unlock the lock.

As an optimized technical scheme, the mentioned primary power source is the main motor and the auxiliary power source is the auxiliary motor, which are controlled by mutually independent control circuits.

As an optimized technical scheme, the mentioned main motor, auxiliary motor and slider can be installed on the slidable bracket.

As an optimized technical scheme, the mentioned devices include the primary power source and the slider bracket and can form a unity with the lock body, which is an integral part of the lock body.

As an optimized technical scheme, the mentioned primary power devices can also be the active force source, cam, slider and breadboard installed in the lock body.

By adopting the above technical scheme, compared with current technology, the invention is reasonably designed in that it controls the double circuit electronic mechanical lock by controlling the rotation of main and auxiliary motors through the electronic control circuit and ensure that the auxiliary motor can still unlock the lock through the auxiliary mechanism when the conventional motor or its driving mechanism fails; when the electronic part does not work, the mechanical emergency unlock can be realized through turning the mechanical key and pulling the bracket to indirectly shift down the slider that limits the movement of lock latch.

The invention will be further described according to the attached figures and specific implementation methods.

DETAILED DESCRIPTION

Examples

Figure 1:
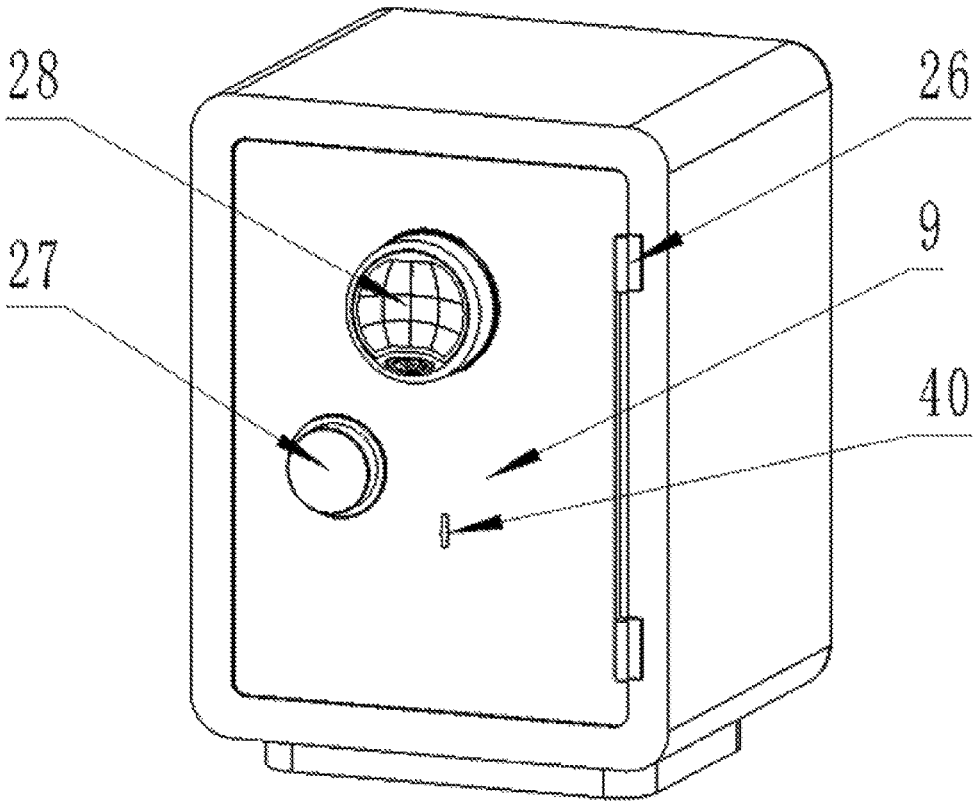
FIG. 1 Appearance view of electronic mechanical lock installed on safe door of an embodiment of the invention.

As shown in FIG. 4-7, dual power electronic mechanical lock includes the lock body 2 and lock lid 14. Lock body 2 is installed with the lock latch 1 (lock tongue), which is installed in the lock body 2 through the rotating recovery mechanism. The mentioned lock body 2 has the primary power device (active force device) to drive and connect the lock latch 1. The primary power device (active force device) is in transmission connection with the lock latch 1. Lock lid 14 has keyhole 41 corresponding to key 43 and lock body 2 has mechanical power device corresponding to the primary power device. Primary power device drives and connects to the mechanical force device. Primary power device is in transmission connection with the mechanical force device.

In this embodiment, the mentioned rotating and recovery mechanism includes the spindle 15 installed in the lock body 2. Spindle 15 is connected to lock latch 1 through the center bore 38 in lock latch 1. The mentioned lock body 2 has been arranged with finite plane 11 and positioning column 35. Tension spring 16 connected to positioning column 35 is connected to lock latch 1 through the connector 17. In this embodiment, connector 17 may be a rivet or bolt.

The mentioned primary power devices include slidable bracket 3 and breadboard 18 (circuit board) installed in the lock body 2; bracket 3 is installed with active force source 12, auxiliary force source 13 and slider 6 connected to lock latch 1; breadboard 18 is connected to active force source 12 and auxiliary force source 13. The mentioned active force 12 and auxiliary force source 13 are at the same center line; the former has cam 10 and the latter has the auxiliary cam 9; cam 10 and auxiliary 9 are mechanically connected with each other. The vertically D-shape cam 10 on the power output shaft of the primary power source (active power source) 12 is driven and connected by the slider 6 through being connected with its special-shaped groove slider 7. The cam 10 is located in the arc groove 19 at the end of the special-shaped groove 7 when it is in the normal state; the cam 10 will be deflected to restrict the slider 6 from moving at the force of the torsional spring 4 installed on the cam 10; the primary power source 12 will rotate by overcoming the torsion of the torsional spring 4; when the platform surface 8 of the cam 10 turns parallel with the special-shaped groove surface 24 of the slider 6, turn the safe handle 27 and push the lock latch 1 blocking surface to rotate inside the lock body 2; the lock latch 1 end will squeeze the slider and move downward by overcoming spring's elastic force. The lock is unlocked.

The mentioned mechanical power devices include keyhole 41 in the lock lid 14 and key 43 running through the keyhole 41; the key 43 is connected to the external safe handle 27. Key 43 is connected to blade group 36 through transmission, which consists of some blades with blade groove 37. Bracket 3 has inserting piece 22 corresponding to blade groove 37. The mentioned blades are connected to bracket 3 through blade groove 37. In actual processing, lock lid 14 is connected to lock body 2 through 4 bolts 42 in a sliding mode.

The mentioned primary power source is the main motor and the auxiliary power source is the auxiliary motor, which are controlled by mutually independent control circuits. The mentioned main motor, auxiliary motor and slider can be installed on the slidable bracket.

In practice, the cam 10 is located in the arc groove at the end of the special-shaped groove when it is in the normal state; the cam 10 will be deflected to restrict the slider from moving at the force of the torsional spring 4 installed on the cam; when the main motor rotates by overcoming the torsion of the torsional spring 4 driven by the control circuit on the breadboard and the platform surface 8 of the cam 10 turns parallel with the special-shaped groove surface 24 of the slider 6, turn the safe handle 27 and push the lock latch blocking surface to rotate inside the lock body; the lock latch 1 end will squeeze the slider 6 and move downward by overcoming spring 5's elastic force. The lock is unlocked.

When the main motor or the control circuit breaks down and the lock cannot be unlocked, input signals to the breadboard control circuit controlling the auxiliary motor and it will rotate driven by the control circuit; it rotates by overcoming the torsion force of torsional spring 4 through the auxiliary cam 9 driving the cam 10 to parallel the platform surface 8 with the special-shaped groove surface 24 and release slider 6. The external force pushes the lock latch 1 to rotate and squeezes slider 6 to move downward to realize the emergency unlock. When the external force disappears, lock latch 1 will return to the original position under the effect of tension spring 16; slider 6 also moves to the original place under the spring action of spring 5. Cam will rotate under the torsion of torsional spring 4 and the platform surface 8 will form a certain angle with the special-shaped groove. Slider 6 will be locked up again and the whole lock is locked.

When the main motor, auxiliary motor and control circuit fails to work, insert key 43 into lock body 2 from keyhole 41 and rotate key 43; key 43 will set the blade in lock body 2 in motion; when the blade is lined up with the blade groove 37, bracket 3 will be pulled by the key; inserting piece 22 in bracket 3 will be inserted into the blade groove 37, then the main motor, auxiliary motor and slider 6 will move down together. The lock is unlocked in a mechanical emergency way.

FIG. 1 is the appearance view of dual power motor mechanical lock installed on safe door. In the figure, the box 90 is connected to door 29 through the hinge 26. Handle 27 is used to control the expansion plate 30. In addition, electronic cipher input device 28 is used to input the password and produce the electronic signal. The keyhole 40 is in the door.

Figure 2:
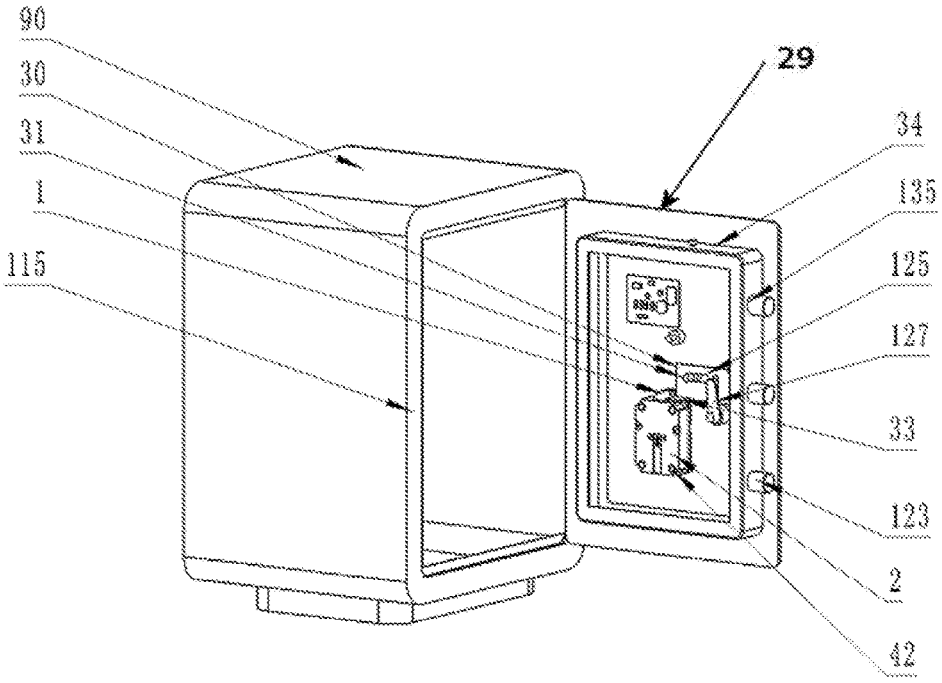
FIG. 2 State view of locked electronic mechanical lock installed on safe door of an embodiment of the invention.

FIG. 2 is the view of dual power electronic mechanical lock installed on safe door. Lock body 2 and expansion plate 30 are installed inside the safe door 29. Lock body 2 is fixed inside the door 29 through four bolts. Lock bolt 123 is on the expansion plate 30 and fixed inside the keyhole 135. When the door is locked, key bolt 123 stretches out from keyhole 135 and is inserted into door frame 115. The axis of handle 27 runs through door 29 and is connected to the rotating disc 127. Fixed pin 31 is inside the safe door 29; guiding groove 125 and block 33 are on the expansion plate 30; guiding groove 125 on expansion plate 30 is nested on fixed pin 31 and can be moved back and forth. In this way, through the rotation of handle 27, expansion plate 30 will move horizontally on safe door 29 along the guiding groove 125. In practice, turn anticlockwise handle 27 will cause the horizontal movement of expansion plate 30 seen from the front of the safe in FIG. 1; lock bolt 123 stretches out of the door through keyhole 135 and is inserted into door frame 115; the door accesses the locking position. At this moment, lock latch 1 keeps behind the block 33 on the expansion plate 30. As the slider 6 of sliding connection is subject to deflection limitation of master cam 10 and cannot move downward, the safe door 29 is locked.

Figure 3:
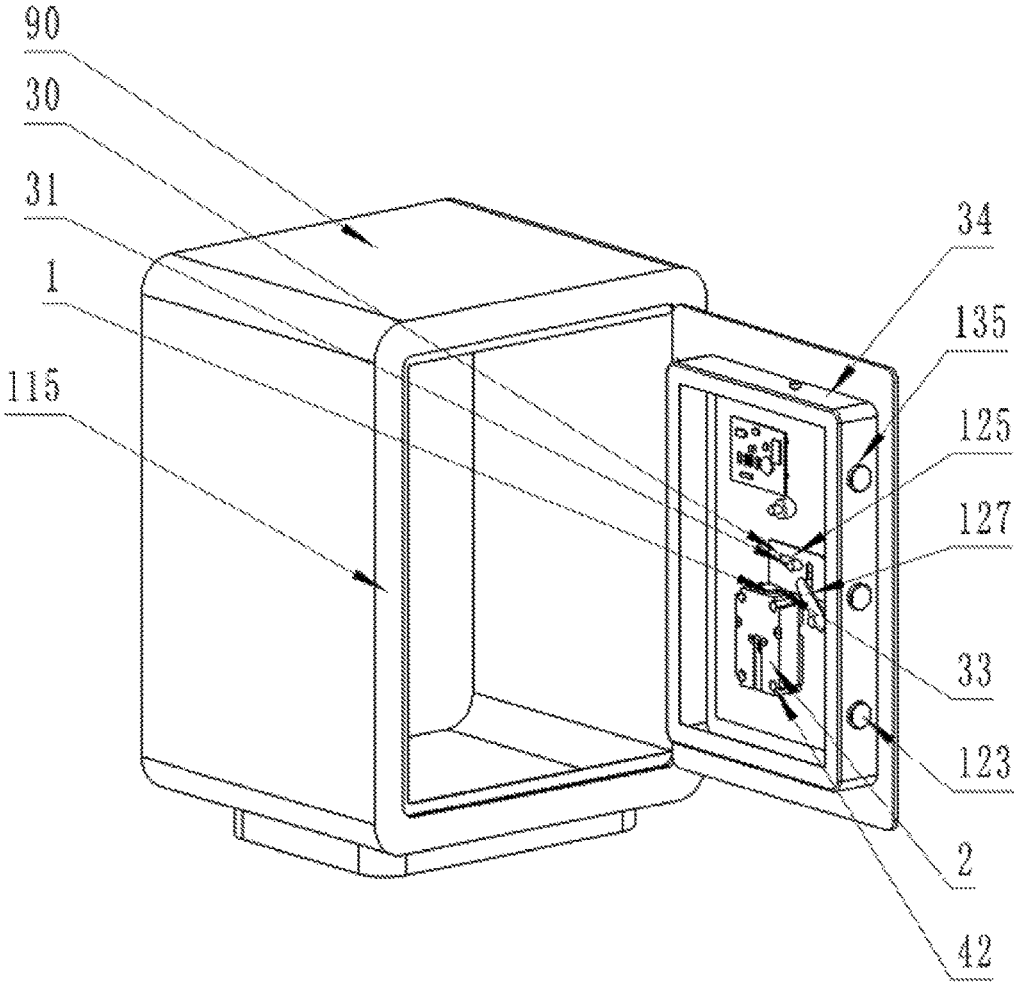
FIG. 3 State view of unlocked electronic mechanical lock installed on safe door of an embodiment of the invention.
Figure 4:
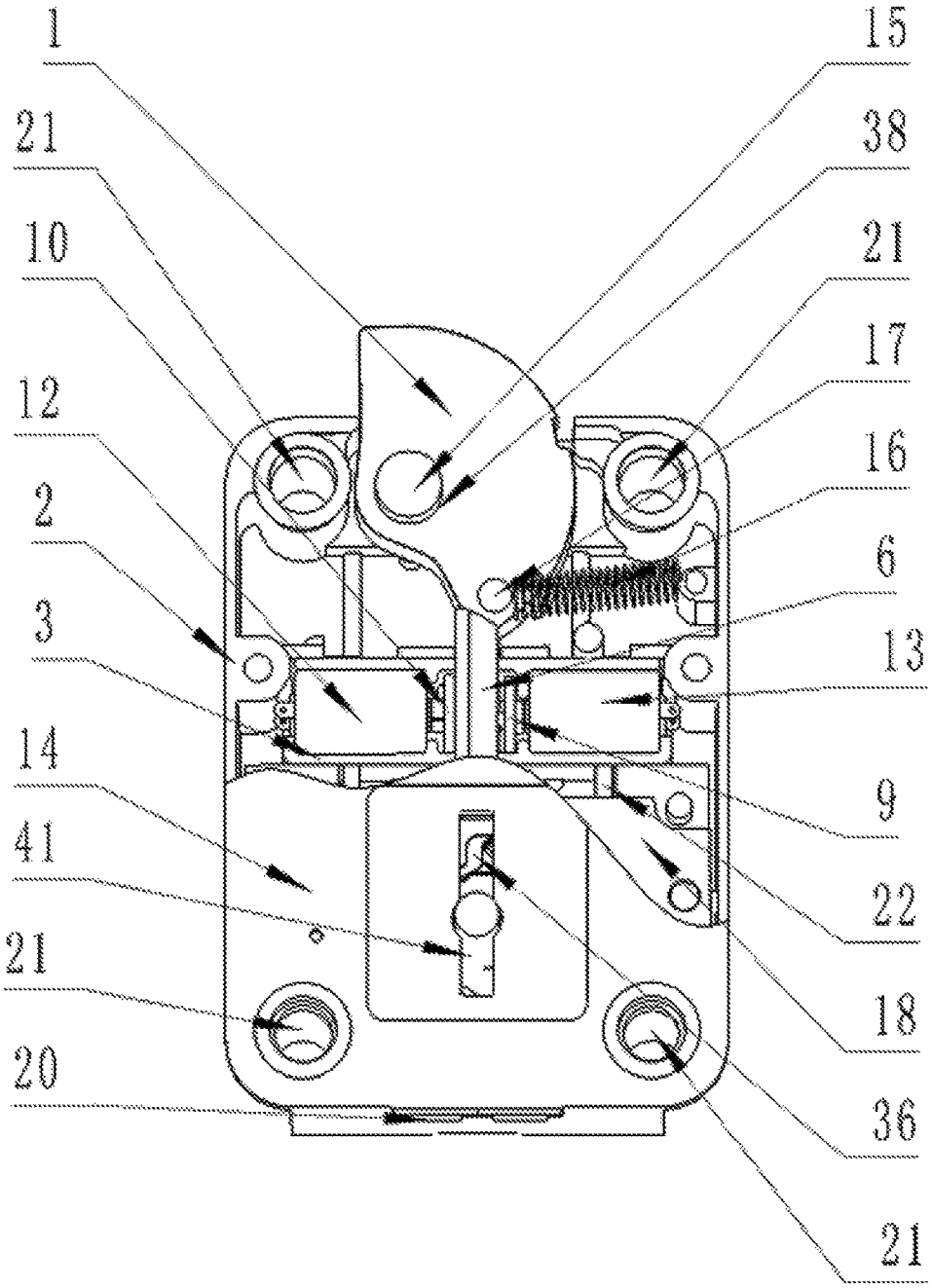
FIG. 4 Internal state view of locked electronic mechanical lock of an embodiment of the invention.
Figure 5:
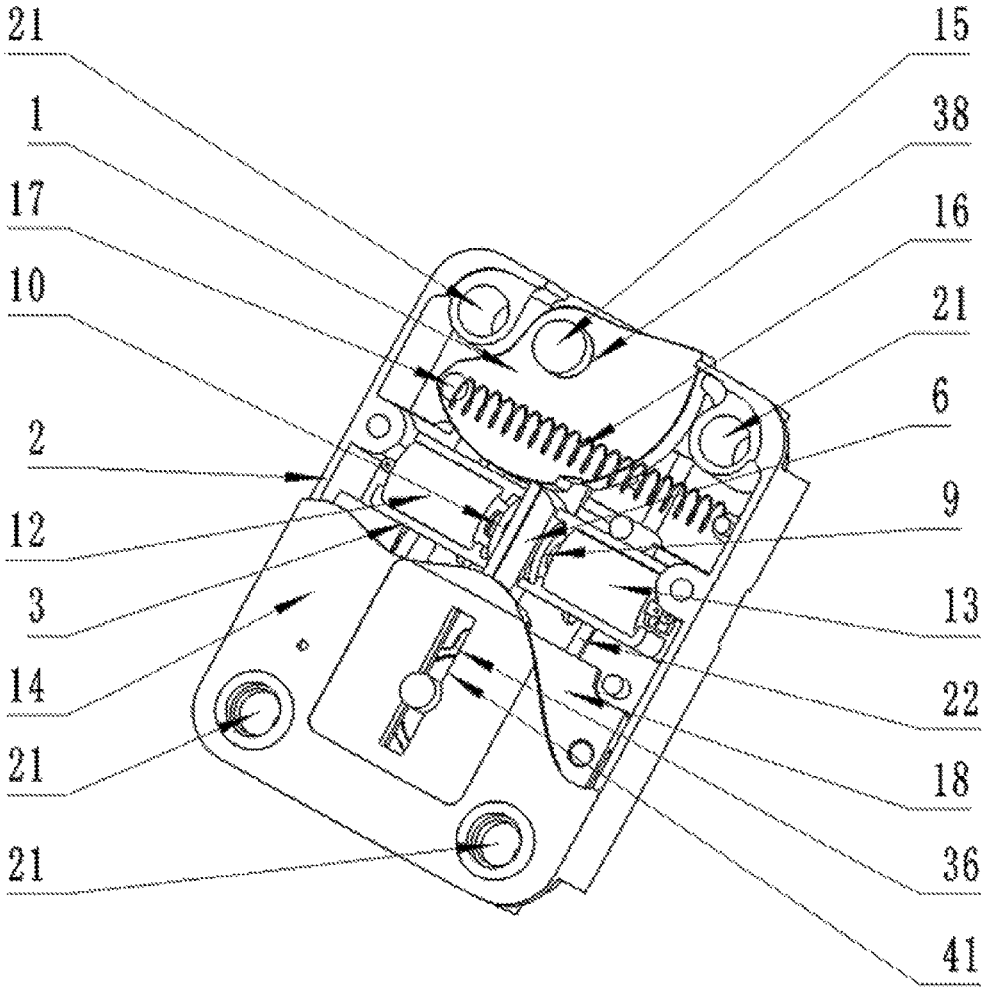
FIG. 5 Internal state view of unlocked electronic mechanical lock of an embodiment of the invention.
Figure 6:
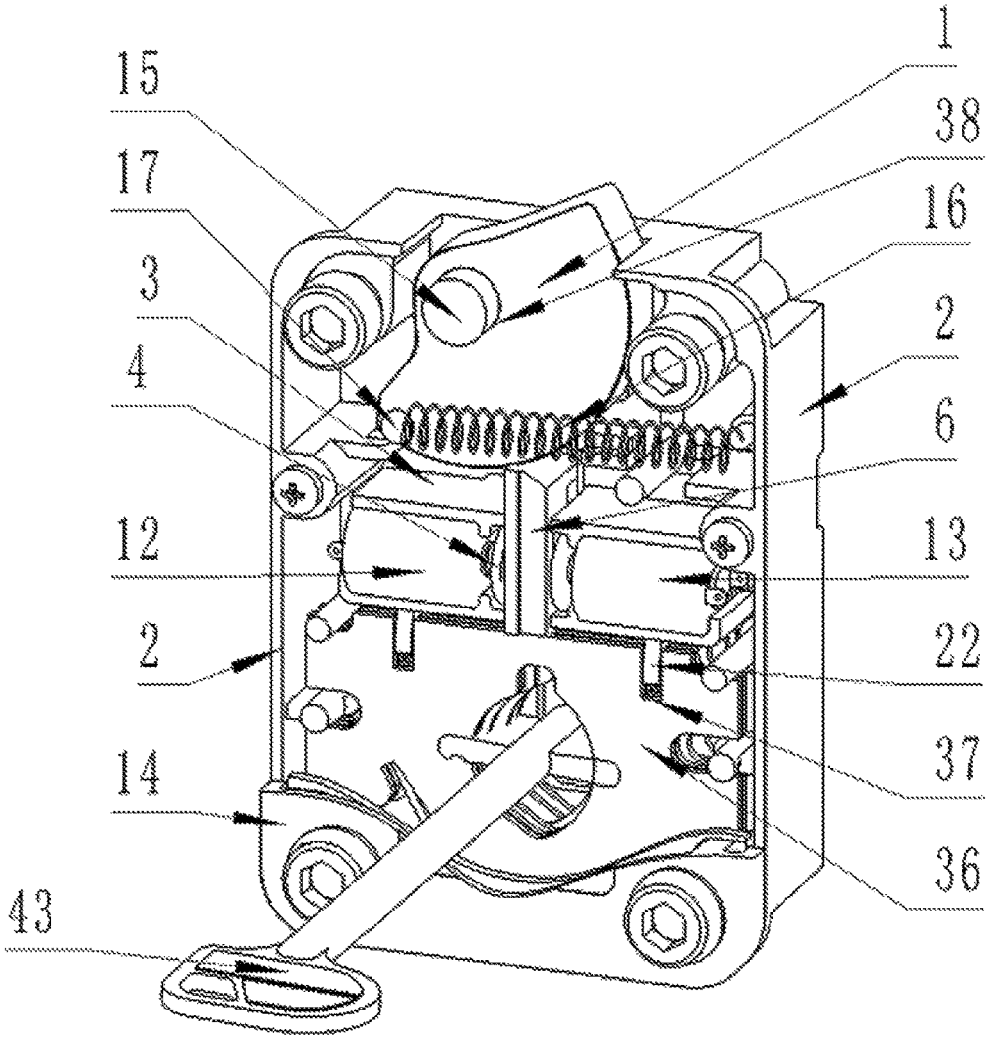
FIG. 6 Internal state view of electronic mechanical lock unlocked by the mechanical key of an embodiment of the invention.
Figure 7:
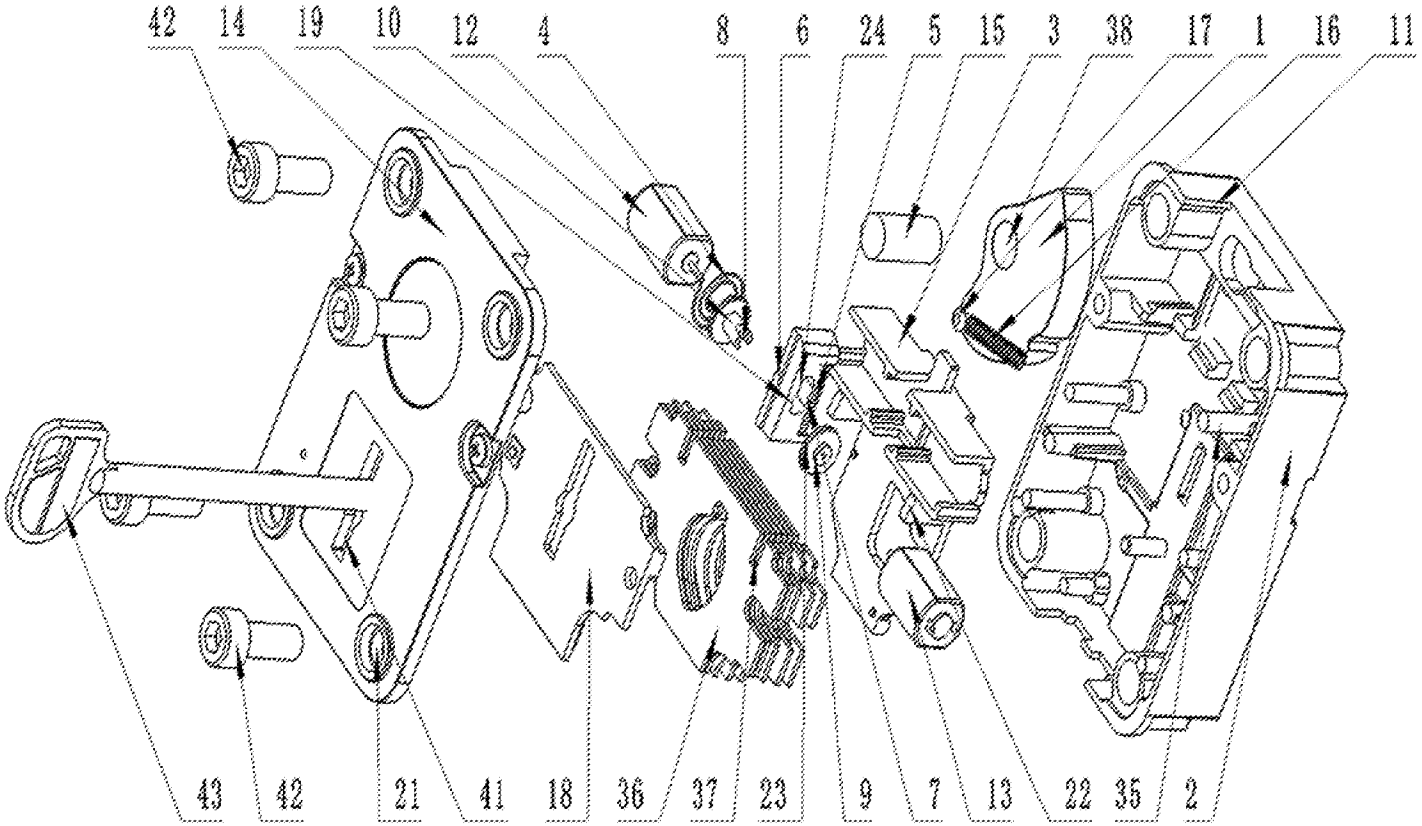
FIG. 7 Structure explosive view of electronic mechanical lock of an embodiment of the invention.

FIG. 3 is the unlocked view of electronic mechanical lock installed inside the safe door. When password is input on the input panel 28 of safe door 29, electrical signal will be generated on the control circuit and transmitted to motor 12; motor 12 will overcome the torsion of the torsional spring 4 on cam 10 and cause the deflection of cam 10 on motor 12 and slider 6 will be released from the lock state. Then rotate door handle 27 clockwise to let expansion plate 30 drive the lock bolt 123 to be pulled back. Block 33 will push the rotation of lock latch 1 to let it deviate from expansion plate 30. Door 29 will be unlocked.

The invention adopts circuit driving motor and the deflection of cam to realize the lock-up and opening of locks. Redundant backups of the auxiliary circuit and drive auxiliary motor are set up to realize the electronic emergency opening of electronic lock; blade mechanical lock is set up in the lock body to control the movement of the bracket and realize the electronic emergency opening of electronic lock, so as to ensure the electronic lock can be opened at any situation.

The invention is not limited to the above preferred implementation schemes. Anybody shall be aware that structure changes made under the inspiration of the invention and all technical schemes that are identical or similar with this invention belong to the protection scope of this invention.

What is claimed is:

1. A dual power electronic mechanical lock, comprising a lock body and a lock lid, wherein, a lock latch is installed in the lock body through a rotating recovery mechanism, a primary power device is installed in the lock body, a keyhole corresponding to a key is located in the lock lid, a mechanical power device corresponding to the primary power device is installed in the lock body, the mechanical power device is in transmission connection with the primary power device, the primary power device includes a bracket and a breadboard which are slidably configured in the lock body;

the bracket is provided with a primary power source, an auxiliary power source and a slider;

the breadboard connects the primary power source and the auxiliary power source;

the primary power source and the auxiliary power source are located in the same center line, with a cam on the primary power source and an auxiliary cam on the auxiliary power source and the cams are mechanically connected with each other;

the cam on a power output shaft of the primary power source is in vertically D-shape, the cam is connected with a special-shaped groove on the slider, the cam is located in an arc groove at an end of the special-shaped groove when it is in normal state, the cam is provided with a torsional spring and is deflected to restrict the slider from moving by a torsion of the torsional spring;

the primary power source rotates by overcoming the torsion of the torsional spring, when a platform surface of the cam turns parallel with a surface of the special-shaped groove of the slider, a safe handle is turned to push the lock latch to rotate inside the lock body, an end of the lock latch presses the slider and the slider moves downward by overcoming elastic force of a spring, and the lock is unlocked.

2. The dual power electronic mechanical lock according to claim 1, wherein, the mechanical power device includes the keyhole in the lock lid and the key passing through the keyhole;

when the key is inserted into the keyhole, the key is rotated and connected to a blade group composed of a number of blades, and the blades are provided with grooves;

the bracket is provided with an inserting piece;

the key is turned to drive the blades to move relatively and to align the grooves, when the aligned grooves are properly lined up with the inserting piece, the key is further turned to pull the bracket, the inserting piece is inserted into the grooves and sliding movement of the bracket drives the slider to move in unlock direction to unlock the lock.

3. The dual power electronic mechanical lock according to claim 1, wherein, the primary power source is a primary motor and the auxiliary power source is an auxiliary motor, which are controlled by mutually independent control circuits.

4. The dual power electronic mechanical lock according to claim 3, wherein, the primary motor, the auxiliary motor and the slider are installed on the slidable bracket.

5. The dual power electronic mechanical lock according to claim 1, wherein, the bracket provided with the primary power source and the slider is formed as a whole with the lock body.

6. The dual power electronic mechanical lock according to claim 1, wherein, the primary power device is a whole of the primary power source, the cam, the slider and the breadboard installed in the lock body.

7. The dual power electronic mechanical lock according to claim 1, wherein, the primary power device is a whole of the primary power source, the cam, the slider and the breadboard installed in the lock body.

* * * * *